US008074570B2

(12) United States Patent
Grotkowski et al.

(10) Patent No.: US 8,074,570 B2
(45) Date of Patent: Dec. 13, 2011

(54) PRINTING OF LOTTERY TICKETS

(75) Inventors: Dion Grotkowski, Pinckney, MI (US); Michael John Brickwood, Winnipeg (CA); Andrew Wojtowicz, Winnipeg (CA); Lyle Harold Scrymgeour, Oakbank (CA)

(73) Assignee: PoUard Banknote Limited Partnership, Winnipeg, MB (CA)

( * ) Notice: Subject to any disclaimer, the term of this patent is extended or adjusted under 35 U.S.C. 154(b) by 503 days.

(21) Appl. No.: 11/872,833

(22) Filed: Oct. 16, 2007

(65) Prior Publication Data

US 2008/0197621 A1 Aug. 21, 2008

Related U.S. Application Data

(60) Provisional application No. 60/870,772, filed on Dec. 19, 2006.

(51) Int. Cl.
*B42D 15/00* (2006.01)
*B41M 3/14* (2006.01)

(52) U.S. Cl. ..... 101/483; 101/450.1; 283/100; 283/903

(58) Field of Classification Search ..... None
See application file for complete search history.

(56) References Cited

U.S. PATENT DOCUMENTS

| | | | | |
|---|---|---|---|---|
| 5,074,566 | A * | 12/1991 | Desbiens | 273/269 |
| 5,569,512 | A | 10/1996 | Brawner | |
| 5,704,647 | A | 1/1998 | Desbiens | |
| 6,347,794 | B2 * | 2/2002 | Scrymgeour et al. | 273/138.1 |
| 2002/0117803 | A1 * | 8/2002 | Weingardt | 273/269 |

FOREIGN PATENT DOCUMENTS

| | | |
|---|---|---|
| WO | WO 02093474 | 11/2002 |

* cited by examiner

*Primary Examiner* — Joshua D Zimmerman
(74) *Attorney, Agent, or Firm* — Adrian D. Battison; Ade & Company Inc.

(57) ABSTRACT

In a row of lottery tickets each ticket has variable image printing game data printed onto a base layer on a substrate and a series of covering layers including at least one sealing layer and at least one scratch-off layer. Onto the scratch-off layer is a multi-color digital image for each ticket using a variable image printing system. At least part of the scratch-off layer can be left free from printed overlay graphics and the multi-color digital image can be printed subsequently at a different location from the ticket manufacturing location. The graphics can indicate different values for different ones of the tickets. The tickets in the row can be of different lengths and the graphics can be different for different length ones of the tickets.

21 Claims, No Drawings

PRINTING OF LOTTERY TICKETS

This application claims the benefit under 35 U.S.C.119 of the filing date of the Provisional Application, Ser. No. 60/870,772, filed Dec. 19, 2006.

This invention relates to the printing of lottery tickets.

BACKGROUND OF THE INVENTION

Lottery tickets commonly include a substrate on which is printed game data in a game play area which is then covered by a coating of a scratch-off material to allow the player to reveal the game data or selected parts of the game data to play the game. An important aspect of such tickets is that of providing an attractive and aesthetic appearance which acts to attract the customer to purchase. Typically such tickets have an overprint layer applied onto the scratch-off coating so as to identify the areas to be scratched and to provide an attractive appearance, bearing in mind that the majority of the area of the front of the ticket is taken up by the game area. While the material printed is relative simple in most cases, attempts have been made to make the ticket more attractive by applying more complex images onto the game area.

In U.S. Pat. No. 5,569,512 (Brawner, Jon M) assigned to Dittler Brothers Incorporated and entitled Card with integrated overprinting is disclosed lottery tickets which utilize continuous overprint inks that mask the boundaries between their "secure" and "unsecure" portions to inhibit unscrupulous players from successfully tampering with them. The method uses reformulated overprint inks to permit a single set to be applied to both portions of a card. The method is stated to have the advantages that more vibrant and aesthetically pleasing graphics may be displayed as well while utilizing fewer printing stations during the printing process.

In U.S. Pat. No. 5,704,647 (Desbiens, Jean-Pierre) assigned to BABN Technologies Corporation and entitled Multi-color overprinting of scratch-off lottery tickets there is disclosed a method of producing a lottery ticket and lottery tickets produced thereby wherein an overprinting layer is provided over a scratch-off layer, the overprinting layer comprising an image obtained from a design in which the colors in the design have been separated into half tone images of each color and are superimposed on the scratch-off layer of the lottery ticket.

Lottery tickets are printed at high speed using printing rollers for the repeated sections of the tickets such as the basic graphics, the security and base layers, the covering layers of varnish and the like, the scratch-off coating and the overprint layer. The game data are printed on the ticket generally using an ink jet printer controlled by a computer to apply the different game data for each of the tickets. The game data generally also includes an identifying bar code (or machine readable code) which again is unique to the ticket concerned. The game data are generally relatively simple often being merely numbers or letters which can be readily printed by the ink jet printer. Thus the overprint images are printed using the conventional printing press which includes a printing roller for each of the different colors. The printing roller system is used because it provides the high speeds necessary for commercial production of such tickets and because it applies inks which can be selected to ensure proper coverage over the underlying material regardless of its characteristics.

SUMMARY OF THE INVENTION

It is one object of the invention to provide an improved method of printing a lottery ticket.

According to one aspect of the invention there is provided a method of printing a row of lottery tickets comprising:

providing a substrate in a continuous strip;

printing onto the substrate in the continuous strip for each ticket of the row of tickets using a repetitive printing roller one or more base layers;

printing onto the base layers in the continuous strip for each ticket of the row of tickets game data using a variable image printing system so that the game data of each ticket is different from the game data of a next adjacent ticket in the row;

printing onto the game data on the base layers in the continuous strip for each ticket of the row of tickets using a series of repetitive printing rollers a series of covering layers including at least one sealing layer and at least one scratch-off layer;

and printing onto the scratch-off layer a multi-color image for each ticket of the row of tickets in the continuous strip using a variable image printing system.

In addition to the game data the tickets will also generally contain validation and inventory information in machine readable and/or human readable formats.

The multi-colour, variable imaging of the graphics can be applied to both the game area and non-game areas of the ticket. Conceptually the entire front surface of the ticket could be printed continuously.

The variable image printing system used for the application of the game data is a different system from the variable image printing system used for the graphic areas over the play and non-play areas of the ticket. These are distinct systems although the technology is similar.

Preferably the multi-color image of each ticket is different from that of the next adjacent tickets.

Preferably, in the row of tickets, the number of different printed multi-colored images is greater than 5.

Preferably the substrate is moving at a rate greater than 300 and commonly greater than 500 ft per minute during the printing of the multi-colored images.

Preferably the multi-colored images are printed by an ink jet printing system.

Preferably the multi-colored images are printed by laser printing system.

Preferably the multi-colored images cover all of the play area of each ticket.

Preferably the variable image printing system is inline with the printing of the covering layers.

Preferably the variable image printing system is on a separate printing line from the printing of the covering layers.

According to a second aspect of the invention there is provided a method of printing a row of lottery tickets comprising:

providing a substrate in a continuous strip;

printing onto the substrate in the continuous strip for each ticket of the row of tickets using a repetitive printing roller one or more base layers;

printing onto the base layers in the continuous strip for each ticket of the row of tickets game data using a variable image printing system so that the game data of each ticket is different from the game data of a next adjacent ticket in the row;

printing onto the game data on the base layers in the continuous strip for each ticket of the row of tickets using a series of repetitive printing rollers a series of covering layers including at least one sealing layer and at least one scratch-off layer;

wherein at least part of the scratch-off layer is free from printed overlay graphics;

and subsequently at a different location printing onto the scratch-off layer a multi-color digital image for each ticket using a variable image printing system.

Preferably each ticket is printed when separated from the others of the row. Thus the individual tickets can be distributed to retailers and sold to a customer and the graphics customized by and printed for the customer as an individual ticket.

Typically even in a system in which the individual tickets are being printed with unique graphics by the customer, the tickets are sold to the retailer in joined sections versus singles. The retailer typically separates the ticket from the balance of the book at the point of purchase. However sale in singles is possible.

Preferably the method includes vending the tickets to a retail customer while the part of the scratch-off layer is free from printed overlay graphics.

Preferably the tickets are printed separately in a printing machine from an image selected by a customer of the ticket.

Preferably the method includes providing a printing machine at a retail vending location for printing of the overlay graphics under control of a customer of the ticket from an image selected by the customer.

According to a third aspect of the invention there is provided a method of printing a row of lottery tickets comprising:

providing a substrate in a continuous strip;

printing onto the substrate in the continuous strip for each ticket of the row of tickets using a repetitive printing roller one or more base layers;

printing onto the base layers in the continuous strip for each ticket of the row of tickets game data using a variable image printing system so that the game data of each ticket is different from the game data of a next adjacent ticket in the row;

printing onto the game data on the base layers in the continuous strip for each ticket of the row of tickets using a series of repetitive printing rollers a series of covering layers including at least one sealing layer and at least one scratch-off layer;

and leaving at least part of the scratch-off layer free from printed overlay graphics. The ticket may thus present a blank white portion for over printing by the customer. In addition to the "at least part of the scratch-off layer free from printed overlay graphics" there could be at least part of the non-play area which is free from printed graphics.

According to a fourth aspect of the invention there is provided a method of printing a row of lottery tickets comprising:

providing a substrate in a continuous strip;

printing onto the substrate in the continuous strip for each ticket of the row of tickets using a repetitive printing roller one or more base layers;

printing onto the base layers in the continuous strip for each ticket of the row of tickets game data using a variable image printing system so that the game data of each ticket is different from the game data of a next adjacent ticket in the row;

printing onto the game data on the base layers in the continuous strip for each ticket of the row of tickets using a series of repetitive printing rollers a series of covering layers including at least one sealing layer and at least one scratch-off layer;

and printing onto the row of tickets different graphics for different ones of the tickets of the row indicating different values for different ones of the tickets.

Preferably the different graphics for the different tickets are printed onto the scratch-off layer as a multi-color digital image for each ticket of the row of tickets in the continuous strip using a variable image printing system.

Preferably the different value indicates a different purchase cost value and/or a different prize value. In this way the tickets of a book or row can be of different values each from another or a series of different values while using the same underlying computer generated game indicia.

Preferably different ones of the tickets are of different lengths along the row.

According to a fifth aspect of the invention there is provided a method of printing a row of lottery tickets comprising:

providing a substrate in a continuous strip;

printing onto the substrate in the continuous strip for each ticket of the row of tickets using a repetitive printing roller one or more base layers;

printing onto the base layers in the continuous strip for each ticket of the row of tickets game data using a variable image printing system so that the game data of each ticket is different from the game data of a next adjacent ticket in the row;

printing onto the game data on the base layers in the continuous strip for each ticket of the row of tickets using a series of repetitive printing rollers a series of covering layers including at least one sealing layer and at least one scratch-off layer;

forming the row into tickets of a different length from each other;

and printing onto the row of tickets different graphics for different length ones of the tickets of the row.

Preferably the method includes fan folding the row of tickets into fan folded strip portions of equal lengths where each strip portion contains more than one ticket.

Preferably the different graphics for the different tickets are printed onto the scratch-off layer as a multi-color digital image for each ticket of the row of tickets in the continuous strip using a variable image printing system.

Also in accordance with the present invention is included a ticket when printed by any of the methods as defined above.

DETAILED DESCRIPTION

The method of the present invention prints lottery tickets in a row using primarily conventional printing techniques.

Further information concerning such techniques is disclosed in prior US patents of the present assignee, the disclosure of which is incorporated herein by reference, as follows:

U.S. Pat. No. 6,145,885 issued Nov. 14, 2000;

U.S. Pat. No. 6,234,477 issued May 22, 2001; and

U.S. Pat. No. 6,347,794 issued Feb. 19, 2002.

Conventional techniques provide a strip of a substrate material which has a width sufficient to constitute a number of such tickets side by side. The strip is in effect continuous so that it is supplied from a roll supply at one end of the printing process and is re-rolled downstream of the printing process.

The first step in the printing process carried out on a first printing line involves the application to the substrate of base materials which can include graphics and covering layers for the game area of the front face of the ticket. As previously stated the width of the strip is sufficient to constitute the number of tickets side by side and the strip is printed with a series or row of tickets arranged longitudinally along the strip end to end.

The printing is carried out on printing rollers so that the strip passes over the printing roller commonly having a circumference of the order of 24 inches. Such a circumference allows the roller to print a series of tickets end to end and a series of the tickets side by side.

Thus in the first printing process the base layer of the tickets are printed onto the substrate including in many cases coloured graphics for the areas surrounding the game area. The game area is typically formed by a laid base layer often white in colour so as to form a "lily-pad". This lily pad provides a base for the game data so that it can be readily viewed by the player after scratching of the ticket. The lily pad often contains base layers which interfere with viewing of the game data other than by removal of the scratch-off coating.

Persons skilled in the art are aware of the security measures taken to provide the suitable base layer or lily pad for the game data.

The printing of different colours in most cases is carried out using a multi-coloured process commonly a four color process commonly utilized in the printing industry. The four colors are of course printed on sequential printing rollers so that each is applied over the next. This can provide a multi colour graduated or semi-tone colour image. However block colours can also be utilized.

In yet other arrangements the base graphics can be printed at a later stage and the initial printing step is limited to the preparation layer or base layer for the game area.

In a second printing line individual data for the individual tickets is applied to the tickets using a variable image printing system commonly an inkjet or bubble-jet system. The individual game data for the individual tickets generally includes indicia printed in the game area indicating to the player whether the ticket is a winning or losing ticket. This game data is commonly a single color so as to allow a simple high speed printing process.

The game data or ticket data applied to the individual tickets also includes a machine readable code or bar code which is printed onto the ticket either in the game area to be covered by scratch-off or in the area to remain exposed or part of the bar code can be printed in both areas with the total bar code being formed by the separate sections in the separate areas.

The ticket information provided by the bar code and the game data is controlled by a computer process so that it is carefully correlated and controlled so that the tickets are individual and unique and allowing the computer system to maintain a table identifying the game data relative to the bar code for subsequent authentication of winning tickets and submission of prizes based upon those winning tickets.

In a third printing line, the game data and the remaining area of the base layers previously printed are covered by further layers providing the scratch-off system. The further layers include sealing layers, varnishes and other security layers well known to a person skilled in the art which provide a base onto which a scratch-off coating can also be printed in the printing line. Scratch-off coating commonly is formed also by a series of different layers again known to a person skilled in the art which amalgamate to form a material which can be readily scratched by the player with the scratch-off coating being separated from the underlying varnishes leaving the game data intact on the base layers.

The upper surface of the scratch-off coating so formed is commonly porous and irregular so that it provides a generally less than suitable base for further printing of additional inks on top of the scratch-off coating.

In a fourth printing process the ticket including the scratch-off coating has further printed onto the surface thereof an image using a variable image printing system.

At some stage during the printing process, the tickets are die cut so as to separate the side by side rows of tickets and to provide perforations transversely of the row of tickets so that each can be separated from the next. In some cases the tickets are completely separated each from the next for sale in stacked form. In some cases the tickets remain attached at the perforations and are commonly sold in fan folded condition.

In the conventional printing technique using a printing roller, the number of different images which can be printed onto a row of tickets is limited to a number of the order of four or less in view of the limited circumference of the printing roller. However utilizing a variable image printing system driven by the computer, the number of images which can be printed onto the tickets can be dramatically increased from at least five up to the limitations of current and future digital printing technologies.

A typical book of 100 tickets of a game, such as the conventional "match three of six" style manufactured today, has a single overprint design that incorporates the same colour and graphic elements for each ticket in the book. In contrast, the use of variable imaged overprinting could potentially offer a unique colour and design for each ticket in the book.

This would offer a significant increase in ticket security against invasive methods of ticket pre-screening being attempted typically by retailers of the tickets.

Another security advantage is that each ticket may have a unique design, and therefore potentially identifying the position of underlying indicia, necessary to attempt to identify those indicia by pin-pricking or similar methods, based on the overprint design is made more difficult.

Another security advantage is that, since each ticket may possess a unique colour, the repair of a tampered ticket would be more difficult.

In theory each of the tickets can be printed with an image which is different from all of the other tickets. However in practice, the number of images can be of the order of several hundreds or thousands based on the capability and processing of the technology being utilized.

The ability to print a large number of different images therefore allows the tickets to be individual and thus provide an attractive effect to the potential customer. The ability to produce different images can be used in many different game styles where the different images provide an incentive to the customer to purchase particular tickets or even a series of the tickets. In order that there is no indication to the customer as to whether the ticket is a winning or losing ticket, the images printed on the scratch-off coating are not in any way related to the winning or losing characteristic and are applied randomly.

A number of difficulties arise in providing a computer controlled variable imaged printing system to apply printing onto the scratch-off coating.

In a first difficulty it is necessary that the printing process be carried out at the speed preferably greater than 300 feet per minute and generally greater than 500 feet per minute in order that the printing process be effected at a commercially viable speed which is normally at least 500 feet per minute. It will be appreciated that in order to manufacture lottery tickets at a suitable price per ticket, the printing process must be carried out at high speed in order to provide sufficient production rate.

In a second difficulty, the exposed surface of the scratch-off coating has characteristics which make the application of many printing materials difficult or impossible. The scratch-off coating is commonly porous so that it can absorb ink. The surface may be irregular so that the printing does not appear complete or continuous and has an appearance which is unacceptable in regard to presenting the image to the potential customer.

These problems can be solved using different techniques.

In a first potential printing system, the variable image printing is effected using an ink jet system where the row of tickets is passed underneath an inkjet printer dispensing jets or dots of ink onto the surface at the required locations. In order to provide a multi color image, it is necessary that the inkjet be applied in a gradated or half-tone arrangement in the different colors, generally four colors but possibly more colors.

In order to ensure that the ink jet system effectively applies a suitable ink to the scratch-off coating, modifications are or may be required of the imaging technology and application process, chemistry of the imaging ink or other print medium, chemistry of the white scratch-off and/or white overprint.

Ink jet may be of the drop-on-demand or continuous stream formats. Ink type may be water based, solvent based or UV curable.

As an alternative, the printing system may utilize a powder deposition system using electrostatic forces to apply the powder to the substrate. Commonly such systems utilize a laser to generate the pattern of electro static forces for application of the toner powder.

While toner powder can provide the required application of pigment, regardless of the irregularity of the surface of the scratch-off material, difficulties may arise in respect of the fixing of the toner powder in view of the fact that the substrate is not merely paper but carries the additional layers identified above.

Modifications to this printing process to accommodate the above factors may include the provision of a vision system to detect register and dot placement for each colour.

Modifications to this printing process to accommodate the above factors may include configuration of the drying technology.

Another option is to have a ticket where the play symbols are variably imaged with basic symbols which are themselves devoid of information denoting a value, for example holiday symbols (wreath, stocking, etc.) A typical game is that of the conventional "Match 3 of 6". After printing the base ticket and the scratch-off coating as previously described, the variable image digital over-printing technique described herein is used to apply an overprinting for different tickets of the book or row of tickets such that different tickets contain an overprinting indicating a different price or value and therefore the prize legend imaged on the base graphics would change. For example one ticket may be priced at $1 and have the matched three symbols winning $2, while the next ticket could be priced at $2 and the matched three symbols would win $4. Conceptually there could be completely different graphics, etc on each of the tickets in the book thus providing different price values and different winning values. Typically where there are multiple prices within the book, the value of the different prizes at the different price levels will be shown in a prize grid which is printed at the same time as the price point and graphics. The grid would show for example that a set of cherries is worth $4 on a $2 ticket versus a prize of $2 on a $1 ticket.

A further option is to have multiple sized tickets within a book each at a different price point. For example if the book is folded in 10 inch fan-folded strips you could have three 2 inch high tickets priced at $1 and one 4 inch ticket priced at $2. In a similar fashion you could have one 2 inch, one 4 inch and one 6 inch ticket all in a 12 inch fold. Each of the different price points could be a completely different game. This would benefit small lotteries especially since they could combine multiple different ticket types to achieve more efficient production and thus pricing.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method of printing a row of lottery tickets comprising:

in a printing process at a printing facility carrying out all the following steps:

providing a substrate in a continuous strip;

printing onto the substrate in the continuous strip for each ticket of the row of tickets using a repetitive printing roller one or more base layers;

printing onto said one or more base layers in the continuous strip for each ticket of the row of tickets game data using a first variable image printing system so that the game data of each ticket is different from the game data of a next adjacent ticket in the row;

printing onto the game data on said one or more base layers in the continuous strip for each ticket of the row of tickets using a series of repetitive printing rollers a series of covering layers including at least one sealing layer and at least one opaque scratch-off layer so that the game data are hidden from view until exposed by removing said at least one scratch-off layer;

printing onto the scratch-off layer in the continuous strip for each of the tickets of the row of tickets a multi-color digital image different from the game data using a second variable image printing system;

and using the second variable image printing system to change the image printed so that different images are printed on different tickets of the row.

2. The method according to claim 1 wherein, in the row of tickets, the number of different printed multi-colored images is greater than 5.

3. The method according to claim 1 wherein substrate is moving at a rate greater than 500 ft per minute during the printing of the multi-colored images.

4. The method according to claim 1 wherein the multi-colored images are printed by an ink jet printing system.

5. The method according to claim 1 wherein the multi-colored images are printed by laser printing system.

6. The method according to claim 1 wherein the game data of each ticket is printed in .a play area of the respective ticket and wherein the multi-colored image printed on each ticket covers all of the play area of the respective ticket.

7. The method according to claim 1 wherein the second variable image printing system is inline with the printing of the covering layers.

8. The method according to claim 1 wherein the second variable image printing system is on a separate printing line from the printing of the covering layers.

9. A method of printing a row of lottery tickets comprising:

in a printing process at a printing facility carrying out all the following steps:

providing a substrate in a continuous strip;

printing onto the substrate in the continuous strip for each ticket of the row of tickets using a repetitive printing roller one or more base layers;

printing onto said one or more base layers in the continuous strip for each ticket of the row of tickets game data using a first variable image printing system so that the game data of each ticket is different from the game data of a next adjacent ticket in the row;

printing onto the game data on said one or more base layers in the continuous strip for each ticket of the row of tickets using a series of repetitive printing rollers a series of covering layers including at least one sealing layer and at least one scratch-off layer so that the game data are hidden from view until exposed by removing said at least one scratch-off layer;

printing onto the scratch-off layer in the continuous strip for each of the tickets of the row of tickets a multi-color digital image different from the game data using a second variable image printing system;

and using the second variable image printing system to change the image printed so that different images are printed on different tickets of the row;

wherein at least part of said multi-color image of at least some of the tickets is printed subsequently at a different location.

10. The method according to claim 9 including vending the tickets to a retail customer while a part of the scratch-off layer is free from printed overlay graphics.

11. The method according to claim 9 wherein the tickets are printed separately in a printing machine from an image selected by a customer of the ticket.

12. The method according to claim 9 including providing a printing machine at a retail vending location for printing of the overlay graphics under control of a customer of the ticket from an image selected by the customer.

13. A method of printing a row of lottery tickets comprising:

in a printing process at a printing facility carrying out all the following steps:

providing a substrate in a continuous strip;

printing onto the substrate in the continuous strip for each ticket of the row of tickets using a repetitive printing roller one or more base layers;

printing onto said one or more base layers in the continuous strip for each ticket of the row of tickets game data using a first variable image printing system so that the game data of each ticket is different from the game data of a next adjacent ticket in the row;

printing onto the game data on said one or more base layers in the continuous strip for each ticket of the row of tickets using a series of repetitive printing rollers a series of covering layers including at least one sealing layer and at least one scratch-off layer so that the game data are hidden from view until exposed by removing said at least one scratch-off layer;

printing onto the scratch-off layer in the continuous strip for each of the tickets of the row of tickets a multi-color digital image different from the game data using a second variable image printing system;

using the second variable image printing system to change the image printed so that different images are printed on different tickets of the row;

forming the row into tickets wherein some of the tickets are of a different purchase price from others of the tickets;

such that the different multi-color images of the different tickets provide different graphics for the different purchase price tickets.

14. A method of printing a row of lottery tickets comprising:

providing a substrate in a continuous strip;

printing onto the substrate in the continuous strip for each ticket of the row of tickets using a repetitive printing roller one or more base layers;

printing onto said one or more base layers in the continuous strip for each ticket of the row of tickets game data using a first variable image printing system so that the game data of each ticket is different from the game data of a next adjacent ticket in the row;

printing onto the game data on said one or more base layers in the continuous strip for each ticket of the row of tickets using a series of repetitive printing rollers a series of covering layers including at least one sealing layer and at least one scratch-off layer so that the game data are hidden from view until exposed by removing said at least one scratch-off layer;

printing onto the scratch-off layer in the continuous strip for each of the tickets of the row of tickets a multi-color digital image different from the game data using a second variable image printing system;

using the second variable image printing system to change the image printed so that different images are printed on different tickets of the row;

forming the row into tickets wherein some of the tickets are of a different value from others of the tickets;

such that the different multi-color images of the different tickets provide different graphics for, the different value tickets;

including forming the row into tickets wherein said at least one of the tickets is of a different length from others of the tickets such that the different multi-color image of said at least one of the tickets provides different graphics for the different length tickets.

15. A method of printing a row of lottery tickets comprising:

providing a substrate in a continuous strip;

printing onto the substrate in the continuous strip for each ticket of the row of tickets using a repetitive printing roller one or more base layers;

printing onto said one or more base layers in the continuous strip for each ticket of the row of tickets game data using a first variable image printing system, so that the game data of each ticket is different from the game data of a next adjacent ticket in the row;

printing onto the game data on said one or more the base layers in the continuous strip for each ticket of the row of tickets using a series of repetitive printing rollers a series of covering layers including at least one sealing layer and at least one scratch-off layer so that the game data are hidden from view until exposed by removing said at least one scratch-off layer;

printing onto the scratch-off layer in the continuous strip for each of the tickets of the row of tickets a multi-color digital image different from the game data using a second variable image printing system;

using the second variable image printing system to change the image printed so that different images are printed on different tickets of the row;

forming the row into tickets wherein some of the tickets are of a different length from others of the tickets;

such that the different multi-color image of the tickets provides different graphics for the different length tickets.

16. The method according to claim 15 including fan folding the row of tickets into fan folded strip portions of equal lengths where each strip portion contains more than one ticket.

17. The method according to claim 1 wherein the second variable image printing system is arranged to print both in the game area and non-game areas of the ticket.

18. The method according to claim 9 wherein the second variable image printing system is arranged to print both in the game area and non-game areas of the ticket.

19. The method according to claim 13 wherein the second variable image printing system is arranged to print both in the game area and non-game areas of the ticket.

20. The method according to claim 14 wherein the second variable image printing system is arranged to print both in the game area and non-game areas of the ticket.

21. The method according to claim 15 wherein the second variable image printing system is arranged to print both in the game area and non-game areas of the ticket.

* * * * *